US006092961A

United States Patent [19]

Kilgore

[11] Patent Number: 6,092,961

[45] Date of Patent: Jul. 25, 2000

[54] BEACH RAMP SYSTEM FOR WATERCRAFTS

[76] Inventor: Jeff Kilgore, P.O. Box 609, Flomaton, Ala. 36441

[21] Appl. No.: 09/141,177

[22] Filed: Aug. 27, 1998

[51] Int. Cl.[7] ..... B63C 3/06; B63C 3/08; B63C 3/02; B63C 5/04

[52] U.S. Cl. ..... 405/7; 405/1; 405/2; 405/3; 114/44

[58] Field of Search ..... 405/1–3, 7; 114/44

[56] References Cited

U.S. PATENT DOCUMENTS

| | | | |
|---|---|---|---|
| 4,243,344 | 1/1981 | Gardon | 405/2 |
| 4,468,150 | 8/1984 | Price | 405/7 |
| 4,756,642 | 7/1988 | Quinn et al. | 405/7 |
| 4,944,633 | 7/1990 | Robb | 405/3 |
| 5,067,428 | 11/1991 | Dickerson et al. | 405/1 X |
| 5,186,576 | 2/1993 | Fournier | 405/7 |
| 5,400,733 | 3/1995 | Richter | 405/2 X |

*Primary Examiner*—Eileen Dunn Lillis
*Assistant Examiner*—Tara L. Mayo

[57] ABSTRACT

A beach ramp system for watercrafts comprising at least one set of rails, each set including two rails. Each rail has a cross-section with aligned holes and an axle. Each rail also includes an aperture above the aligned holes with an elastomeric roller support rotatably supported on each axle and extending upwardly through the aperture to thereby constitute a watercraft support. Flanges are located at each end of each rail with openings therethrough. At least one Y-shaped post is provided with each post having an extent cemented in the ground and two upper extents attached to and supporting the rails.

10 Claims, 3 Drawing Sheets

FIG 1
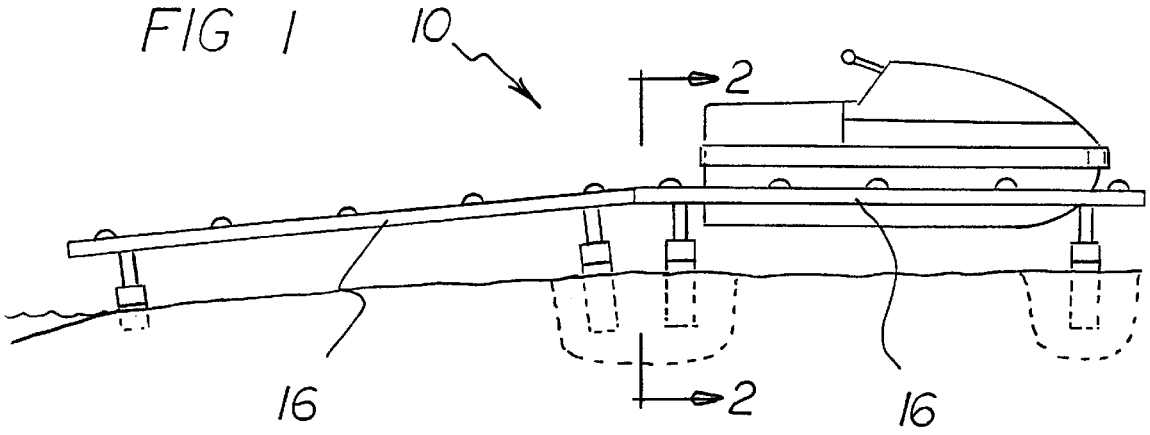
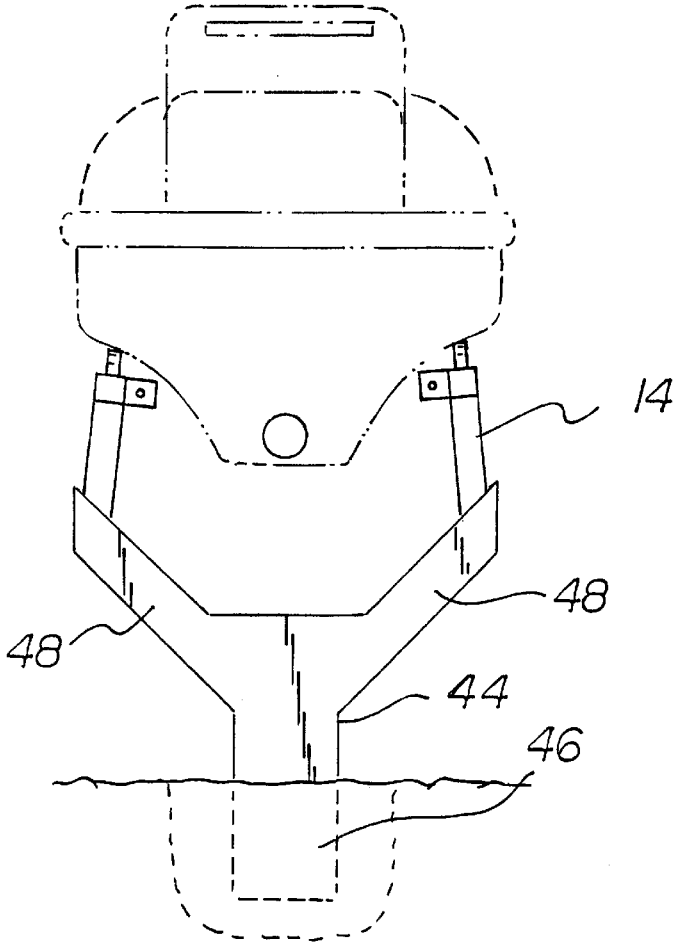
FIG 2

FIG 3
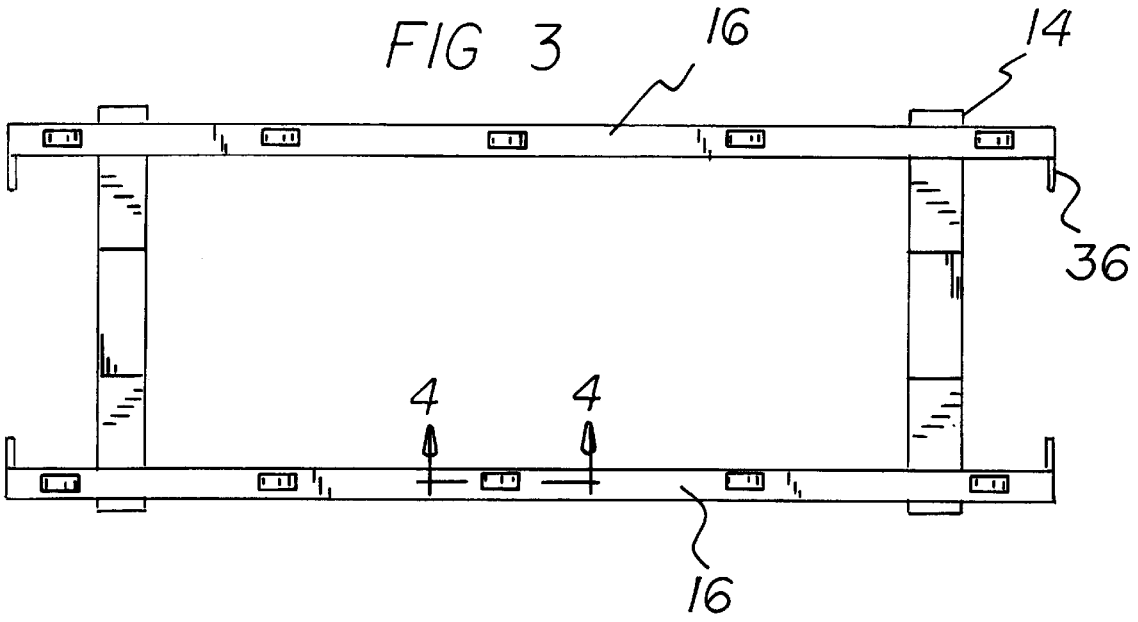
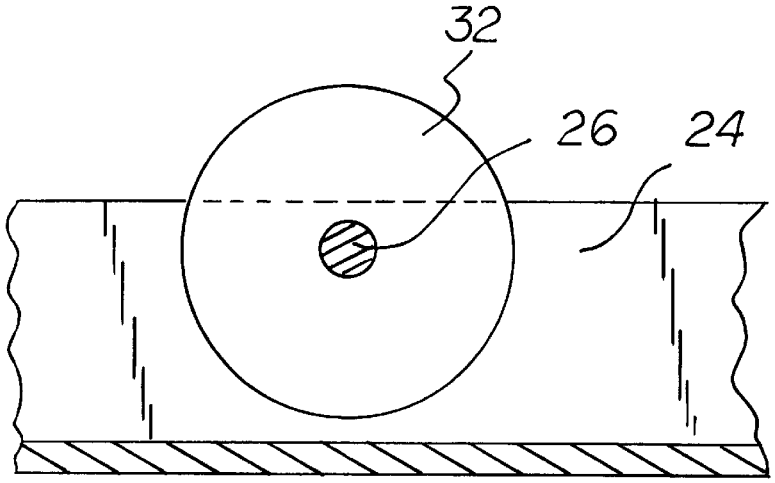
FIG 4

FIG 5
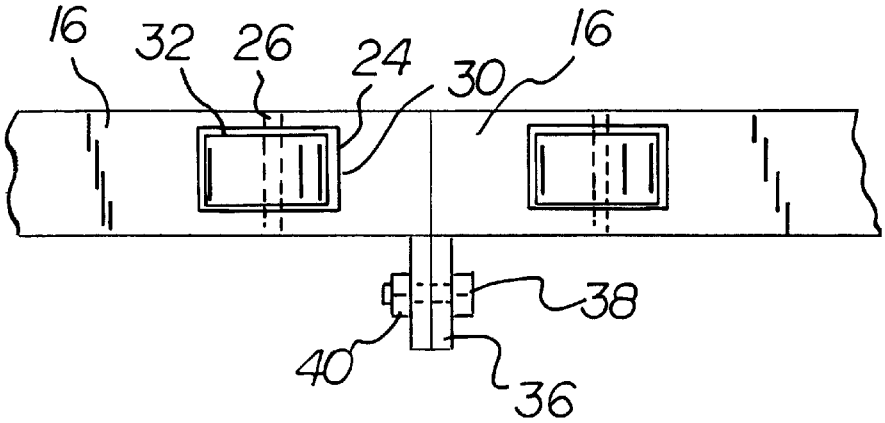
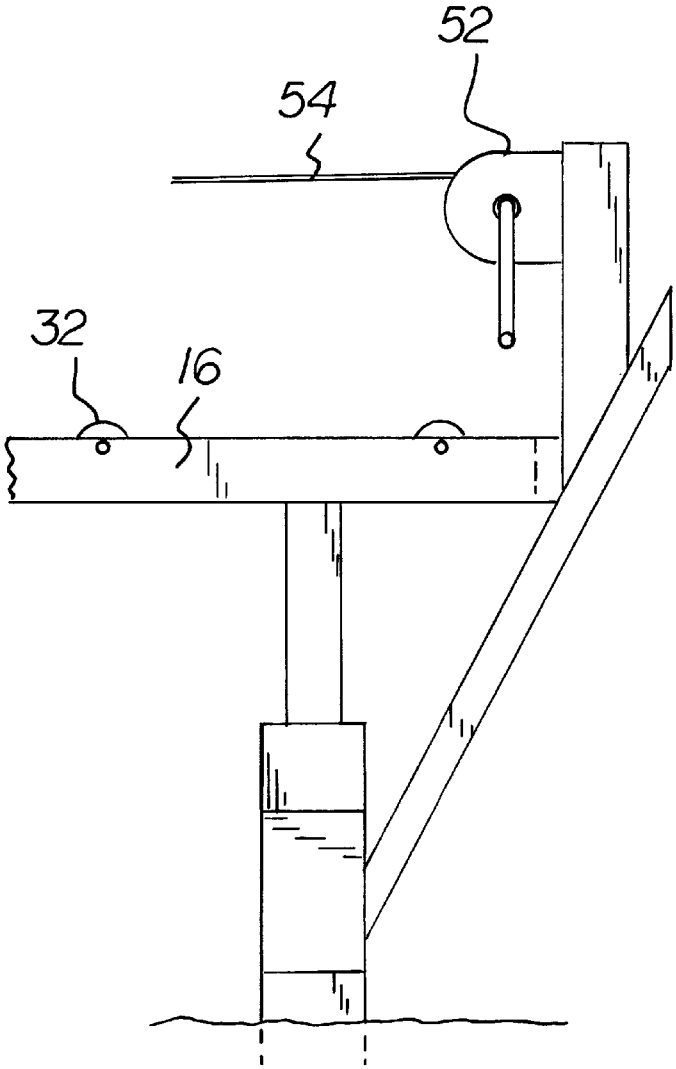
FIG 6

BEACH RAMP SYSTEM FOR WATERCRAFTS

BACKGROUND OF THE INVENTION

1. Field of the Invention

The present invention relates to a beach ramp system for watercrafts and more particularly pertains to facilitating the removal of watercrafts from the water.

2. Description of the Prior Art

The use of watercraft supports of various designs and configurations is known in the prior art. More specifically, watercraft supports of various designs and configurations heretofore devised and utilized for the purpose of removing watercrafts from the water through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,658,354 to Lee discloses a Portable Boat Launching and Beaching Apparatus. U.S. Pat. No. 3,579,996 to Edson discloses a Portable Boat Ramp. U.S. Pat. No. 4,260,282 to Doresey discloses a Portable Boat Ramp. U.S. Pat. No. 4,449,846 to Price discloses a Transverse Saddle Type Boat Cradle. U.S. Pat. No. 4,468,150 to Price discloses an Adjustable Cradle for Supporting and Stabilizing Boats. Lastly, U.S. Pat. No. 4,972,791 to Williams discloses a Boat Protection Device.

In this respect, the beach ramp system for watercrafts according to the present invention substantially departs from the conventional concepts and designs of the prior art, and in doing so provides an apparatus primarily developed for the purpose of facilitating the removal of watercrafts from the water.

Therefore, it can be appreciated that there exists a continuing need for a new and improved beach ramp system for watercrafts which can be used for facilitating the removal of watercrafts from the water. In this regard, the present invention substantially fulfills this need.

SUMMARY OF THE INVENTION

In view of the foregoing disadvantages inherent in the known types of watercraft supports of various designs and configurations now present in the prior art, the present invention provides an improved beach ramp system for watercrafts. As such, the general purpose of the present invention, which will be described subsequently in greater detail, is to provide a new and improved beach ramp system for watercrafts and method which has all the advantages of the prior art and none of the disadvantages.

To attain this, the present invention essentially comprises a new and improved beach ramp system for watercrafts facilitating the removal of watercrafts from the water comprises, in combination a plurality of sets of laterally placed rails each set including two parallel rails at the horizontal and at least two additional rails at an angle offset from the horizontal. Each rail has a rectangular cross-section with a plurality of aligned holes and an axle therebetween. Each rail also includes an aperture above the aligned holes with an elastomeric roller support rotatably supported on each axle and extending upwardly through the aperture to thereby constitute a watercraft support. Also provided are inturned flanges at each end of each rail with openings therethrough to allow the coupling of the flanges and rails to one another by nuts and bolts to thereby create a rail system.

A plurality of Y-shaped posts are provided. Each post has an essentially vertical extent cemented in the ground and two upper extents attached to and supporting the rails in a generally horizontal orientation. A winch is secured to one end of one set of rails with a cable to assist in moving the watercraft up the rail system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beach ramp system for watercrafts which has all of the advantages of the prior art watercraft supports of various designs and configurations and none of the disadvantages.

It is another object of the present invention to provide a new and improved beach ramp system for watercrafts which may be easily and efficiently manufactured and marketed.

It is further object of the present invention to provide a new and improved beach ramp system for watercrafts which is of durable and reliable constructions.

An even further object of the present invention is to provide a new and improved beach ramp system for watercrafts which is susceptible of a low cost of manufacture with regard to both materials and labor, and which accordingly is then susceptible of low prices of sale to the consuming public, thereby making such beach ramp system for watercrafts economically available to the buying public.

Even still another object of the present invention is to provide a beach ramp system for watercrafts for facilitating the removal of watercrafts from the water.

Lastly, it is an object of the present invention to provide a new and improved beach ramp system for watercrafts comprising at least one set of rails, each set including two rails. Each rail has a cross-section with aligned holes and an axle. Each rail also includes an aperture above the aligned holes with an elastomeric roller support rotatably supported on each axle and extending upwardly through the aperture to thereby constitute a watercraft support. Flanges are located at each end of each rail with openings therethrough. At least one Y-shaped post is provided with each post having an extent cemented in the ground and two upper extents attached to and supporting the rails.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the beach ramp system for watercrafts constructed in accordance with the principles of the present invention.

FIG. 2 is cross-sectional view taken along line 2—2 of FIG. 1.

FIG. 3 is a top elevational view of a portion of the system shown in the prior Figures.

FIG. 4 is a cross-sectional view taken along line 4—4 of FIG. 3.

FIG. 5 is an enlarged top view illustrating the coupling of sets of rails.

FIG. 6 illustrates a winch system adapted for use in association with the present invention.

The same reference numerals refer to the same parts through the various Figures.

DESCRIPTION OF THE PREFERRED EMBODIMENT

With reference now to the drawings, and in particular to FIG. 1 thereof, the preferred embodiment of the new and improved beach ramp system for watercrafts embodying the principles and concepts of the present invention and generally designated by the reference numeral 10 will be described.

The present invention, the beach ramp system for watercrafts 10 is comprised of a plurality of components. Such components are individually configured and correlated with respect to each other so as to attain the desired objective.

The new and improved beach ramp system for watercrafts facilitating the removal of watercrafts from the water comprises, in combination a plurality of sets 14 of laterally placed rails 16 each set including two parallel rails at the horizontal and at least two additional rails at an angle offset from the horizontal. The rails 16 of each set are of an equal length.

Each rail has a hollow rectangular cross-section with a plurality of aligned holes 24 formed in opposite side faces thereof with an axle 26 therebetween. Each rail also includes an aperture 30 formed in the top face of the associated rail above the aligned holes with an elastomeric disk-shaped roller support 32 rotatably supported on each axle which is extended upwardly through the aperture to thereby constitute a watercraft support. In the preferred embodiment, at least 5 rollers are mounted on each rail two of which are situated at the ends thereof.

Also provided are inturned flanges 36 at each end of an inboard side face of each rail with openings therethrough to allow the coupling of the flanges and rails to one another by nuts 38 and bolts 40 to thereby create a rail system. A plurality of Y-shaped posts 44 are provided for holding a set of rails at a predetermined distance less than the width of the watercraft to be handled. Each post has an essentially vertical extent 46 cemented in the ground and two upper extents 48 attached to and supporting the rails in a generally horizontal orientation. Each upper extent includes a lower angled portion and an upper essentially vertical portion.

A manual winch 52 is secured to one end of one set of rails with a cable 54 to assist in moving the watercraft up the rail system. The winch is preferably mounted on a vertical post coupled to an end of the horizontal rails. Such vertical post is supported by an angled member coupled between the vertical extent of one of the posts and the bottom of the vertical post. Note FIG. 6.

As described hereinabove, the present invention is a permanently installed dry ramp for a personal watercraft being beached on a lake or river shore. The device keeps the machine elevated above the water line just above any obstructions on the shore. The stand prevents damage to the hull caused by direct contact with rocks or gravel and also prevents an anchored personal watercraft from drifting and being pushed into other nearby boats or obstructions.

The apparatus of the present invention is comprised primarily of two galvanized steel uprights, roller arms and supports. The lower end of the two spaced uprights are cemented into the ground. Atop each upright is a Y-shaped set of forked supports. The supports hold opposite ends of the two parallel roller bars. Each 12-foot bar contains rubber wheels or rollers used for movement of a personal watercraft and support when stored near the shoreline.

Once installed into the ground, the personal watercraft owner can ride, pull or winch the machine up onto the two parallel roller bars. The hull of the machine rests upon the rollers so that the personal watercraft is out of the water and "dry docked". This apparatus is ideally suited for individuals who own personal watercraft and live near the shore.

The appealing features of the present apparatus are its convenience, safety, protection, accessibility, and the peace of mind the personal watercraft owner enjoys. Instead of pulling the small craft up onto rocks or gravel, this permanently installed dry dock can be used. The apparatus elevates the fiberglass bottom and gel coat from sharp objects to maintain the original appearance and condition of the machine. The owner of the watercraft can thereby protect the watercraft and maintain the resale value of it. The present apparatus also eliminates drifting and boat contact that often occurs when anchored in the water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beach ramp system for watercrafts facilitating the removal of watercrafts from the water comprising, in combination:

a plurality of sets of laterally placed rails each set including two parallel rails at the horizontal and at least two additional rails at an angle offset from the horizontal;

said rails each having a rectangular cross-section with a plurality of aligned holes and an axle therebetween, each rail also including an aperture above the aligned holes with an elastomeric roller support rotatably supported on each axle and extending upwardly through the aperture to thereby constitute a watercraft support;

inturned flanges at each end of each rail with openings therethrough to allow the coupling of the flanges and rails to one another by nuts and bolts to thereby create a rail system;

a plurality of Y-shaped posts, each post having an essentially vertical extent cemented in the ground and two upper extents attached to and supporting the rails in a generally horizontal orientation; and a winch secured to one end of one set of rails with a cable to assist in moving the watercraft up the rail system.

2. A beach ramp system for watercrafts comprising:

at least one set of rails, each set including two rails;

a plurality of rollers mounted on each rail;

at least one Y-shaped post, each post having an extent mounted in the ground and two upper extents attached to and supporting the rails; and wherein the upper extents of the Y-shaped post each includes an upper vertical portion and a lower angled portion.

3. The system as disclosed in claim 2 wherein a winch is secured to one end of one set of the rails with a cable for maneuvering a watercraft on the rails.

4. The system as disclosed in claim 2 wherein two sets of said rails are included one of which is horizontally oriented and one of which is angled.

5. The system as disclosed in claim 2 wherein two sets of said rails are included which are removably coupled.

6. The system as disclosed in claim 2 wherein the rollers are disk-shaped and have a width less than that of the associated rail.

7. A beach ramp system for watercrafts comprising:

at least one set of rails, each set including two rails;

a plurality of rollers mounted on each rail;

at least one Y-shaped post, each post having an extent mounted in the ground and two upper extents attached to and supporting the rails; and wherein two sets of said rails are included one of which is horizontally oriented and one of which is angled.

8. The system as disclosed in claim 7 wherein a winch is secured to one end of one set of the rails with a cable for maneuvering a watercraft on the rails.

9. The system as disclosed in claim 7 wherein two sets of said rails are included which are removably coupled.

10. The system as disclosed in claim 7 wherein the rollers are disk-shaped and have a width less than that of the associated rail.

* * * * *